US005130290A

United States Patent [19]

Tanimoto

[11] Patent Number: 5,130,290

[45] Date of Patent: Jul. 14, 1992

[54] WATER-SENSITIVE COLORING SHEET

[75] Inventor: Tadashi Tanimoto, Amagasaki, Japan

[73] Assignee: Kanzaki Paper Manufacturing Co., Ltd., Tokyo, Japan

[21] Appl. No.: 497,205

[22] Filed: Mar. 22, 1990

[30] Foreign Application Priority Data

Mar. 27, 1989 [JP] Japan ..... 1-77706
Apr. 13, 1989 [JP] Japan ..... 1-95936
Dec. 22, 1989 [JP] Japan ..... 1-334272

[51] Int. Cl.[5] ..... B41M 5/28

[52] U.S. Cl. ..... 503/201; 503/200; 503/205

[58] Field of Search ..... 427/150-152; 503/205, 225, 201, 200

[56] References Cited

U.S. PATENT DOCUMENTS 4,170,483 10/1979 Shackle et al. ..... 106/21

FOREIGN PATENT DOCUMENTS 51-44706 11/1976 Japan ..... 503/208
3242677 10/1988 Japan ..... 503/225

*Primary Examiner*—Bruce H. Hess
*Attorney, Agent, or Firm*—Larson and Taylor

[57] ABSTRACT

Disclosed are a water-sensitive coloring sheet comprising:

(a) a substrate and (b) a water-sensitive coloring layer containing a colorless or pale-colored basic dye, a color developing material capable of forming a color on contact with the dye, a densensitizer and a binder, and a method for forming colored image on such water-sensitive coloring sheet by application of water.

15 Claims, No Drawings

WATER-SENSITIVE COLORING SHEET

BACKGROUND OF THE INVENTION

The present invention relates to water-sensitive coloring sheets and more particularly to water-sensitive coloring sheets capable of forming colored images when water is applied thereto.

Known coloring sheets capable of forming colored images by application of water include those comprising a substrate, a colored layer formed from carbon black or the like on the substrate and a hiding layer formed from a white pigment of low refractive index or the like on the colored layer to hide the colored layer. With this type of sheet, the hiding layer portion wetted by the water applied becomes transparent and devoid of hiding power, making the colored layer visible therethrough, whereby colored images are formed.

This type of water-sensitive coloring sheet requires at least two applications of coatings in production to provide a colored layer of carbon black or the like formed on the substrate and a hiding layer formed from a white pigment to hide the colored layer, and involve the application of white pigment in an amount of about 15 to about 25 g/m$^2$ for completely hiding the colored layer, presenting a cost problem.

Coloring sheets are also known which are capable of forming a color on a pH indicator-containing sheet by applying thereto a pH-controlled aqueous solution. This type of coloring sheets, however, can not develop a color if using only water.

SUMMARY OF THE INVENTION

It is an object of the present invention to provide a water-sensitive coloring sheet having a simple structure and capable of forming colored images by merely applying water thereto, and a method for forming colored images using such water-sensitive coloring sheet.

According to the present invention, there is provided a water-sensitive coloring sheet comprising:

(a) a substrate and (b) a water-sensitive coloring layer containing a colorless or pale-colored basic dye, a color developing material capable of forming a color on contact with the dye, a desensitizer and a binder.

According to the invention, there is also provided a method for forming colored images on a water-sensitive coloring sheet comprising:

(a) a substrate and (b) a water-sensitive coloring layer containing a colorless or pale-colored basic dye, a color developing material capable of forming a color on contact with the dye, a desensitizer and a binder, the method comprising applying water to the water-sensitive coloring layer.

According to the present invention, only water is applied to the water-sensitive coloring layer, and thereby causes the wetted surface portion thereof to form a color, giving colored images. Further the water-sensitive coloring sheet of the invention has a simple structure which can be obtained by merely applying to the substrate a coating composition for forming a water-sensitive coloring layer.

The colored images formed on the water-sensitive coloring layer by application of water according to the invention are decolorized on evaporation of water in case a water repellent substrate is used, but are irreversibly left even after evaporation of water in case a porous substrate is used.

DETAILED DESCRIPTION OF THE INVENTION

Colorless or pale-colored basic dyes which can be used in the invention are various and include those heretofore known. Examples are given below.

Triarylmethane-based dyes, e.g. 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol- 3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Thiazine-based dyes, e.g., benzoyl-leucomethylene blue, p-nitrobenzoylleucomethylene blue, etc.

Spiro-based dyes, e.g., 3-methyl-spiro-di-naphthopyran, 3-ethyl-spiro-dinaphthopyran, 3-phenylspiro-dinaphthopyran, 3-benzyl-spiro-dinaphthopyran, 3-methyl-naphtho-(6'-methoxybenzo)spiropyran, 3-propylspiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-di-ethylamino-6,7-dimethylfluoran, 3-(N-ethyl-p-toluidino)-7-methylfluoran, 3-diethylamino-7-(N-acetyl-N-methylamino)fluoran, fluoran, 3-diethylamino-7-(N-methylamino)fluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-(2,4-dimethylamino)fluoran, 3-diethylamino-7-(o-chlorophenylamino)fluoran, 3-dibutylamino-7-(o-chlorophenylamino)fluoran, 3-pyrrolidino-6-methyl-7-(p-butylphenylamino)fluoran, 3-(N-methyl-N-n-amylamino)-6-methyl-7-phenylaminofluoran, 3-(N-ethyl-N-n-amylamino)-6-methyl-7-phenylaminofluoran, 3-(N-ethyl-N-isoamylamino)-6-methyl-7-phenylaminofuluoran, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-$\beta$-ethylhexylamino)-6-methyl-7-phenylaminofluoran, etc. The basic dyes useful in this invention are not limited to those exemplified above, and at least two of them can be used in admixture.

Examples of color developing materials to be used conjointly with the basic dye in the present invention include those heretofore known for use in the fields of, e.g. pressure-sensitive recording sheets and heat-sensitive recording sheets. Examples of such color developing materials are 4-tert-butylphenol, α-naphthol, β-naphthol, 4-acetylphenol, 4-tert-octylphenol, 4,4'-sec-butylidenephenol, 4-phenylphenol, 4,4'-dihydroxydiphenylmethane, 4,4'-isopropylidene diphenol, hydroquinone, 4,4'-cyclohexylidene diphenol, 4,4 -dihydroxy diphenylsulfide, 4,4'-thiobis(6-tert-butyl-3-methylphenol), 4,4'-dihydroxydiphenyl sulfone, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak type phenol resins, phenol polymers and like phenol compounds; benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)-salicylic acid, 3,5-di(α-methylbenzyl)salicylic acid and like aromatic carboxylic acids; salts of these aromatic carboxylic acids with polyvalent metals such as zinc, magnesium, aluminum, calcium, titanium, manganese, tin, nickel or the like organic acidic substances.

As to the mixing ratio of the basic dye and the color developing material, about 50 to about 600 parts by weight, preferably about 100 to about 400 parts by weight, of the color developing material is used per 100 parts by weight of the basic dye. It is possible, when required, to use at least two color developing materials in combination.

The desensitizer for use herein can be any of known desensitizers which are water-soluble. Examples of such desensitizers include glycerin; dodecylamine; 2,4,4-trimethyl-2-oxazoline; N,N-di(polyoxyethylene)ethylamine; polyoxypropylene-diethylamine adducts; polyethyleneimine; polyolefin glycols such as polyethylene glycol, polypropylene glycol and copolymer of ethylene glycol and propylene glycol; cationic surfactants such as dodecyltrimethylammonium chloride, stearylamine acetate or the like; anionic surfactants such as sodium polyoxyethylenealkyl ether sulfate, triethanolamine polyoxyethylenealkyl ether sulfate, sodium polyoxyethylenealkyl phenyl ether sulfate or the like; nonionic surfactants such as polyoxyethylene lauryl ether, polyoxyethylene oleyl ether, polyoxyethylene nonyl phenyl ether, polyoxyethylene sorbitan monolaurate, polyethylene glycol monostearate or the like.

Among these desensitizers, polyethyleneimine having an average molecular weight of about 30,000 to about 100,000, polyolefin glycol having an average molecular weight of about 300 to about 2,000, anionic surfactants and nonionic surfactants are preferred because the use of these desensitizers results in excellent decolorization and color formation.

The desensitizer is used in an amount effective to inhibit the color forming reaction between the basic dye and the color developing material in the absence of water in the water-sensitive coloring layer, and is variable depending on the kind of components, amounts thereof, concentration of the coating composition for forming the water-sensitive coloring layer, porosity of substrate, etc. Generally, the amount of the desensitizer is in the range of about 30 to about 2000 parts by weight, preferably about 50 to about 2000 parts by weight and more preferably about 50 to about 1800 parts by weight, per 100 parts by weight of the color developing material.

As useful binders, various materials are suitably selected according to the particular method of forming the water-sensitive coloring layer. The water-sensitive coloring layer may be formed in various manners, such as, for example, by applying a coating composition therefor to a substrate or by printing with use of an ink composition therefor. When the water-sensitive coloring layer is formed by application of a coating composition onto a substrate, for example, useful binders include starches; hydroxyethyl cellulose; methyl cellulose; ethyl cellulose; carboxymethyl cellulose; gelatin; casein; gum arabic; water-soluble polymers such as polyvinyl alcohol and styrene-maleic anhydride copolymer salt; water-dispersible polymers either in the form of latex or emulsion such as styrene-butadiene copolymer latex, acrylic acid ester polymer emulsion, polyvinyl acetate latex, polyvinyl chloride latex; polymers soluble in an organic solvent such as polyvinylbutyral, polyvinyl acetate, vinyl chloride-vinyl acetate copolymer, acrylic resin, styrene resin, polyester resin, and the like.

When the water-sensitive coloring layer is formed by printing with use of an ink composition containing a colorless or pale-colored basic dye, a color developing material, a desensitizer and a binder, for example, by flexographic or gravure printing method, useful binders include polyvinyl acetate, vinyl chloridevinyl acetate copolymer, styrene-maleic anhydride copolymer, isobutylene-maleic anhydride copolymer, polyvinyl alcohol, modified polyvinyl alcohol, polyvinyl butyral, ethyl cellulose, nitro cellulose, hydroxypropyl cellulose or the like. When the printing is to be conducted with use of a hot-melt type ink composition, useful binders are waxes such as bees wax, carnauba wax, montan wax, paraffin wax, microcrystalline wax, castor wax, akura wax, stearic acid amide, strearic acid, distearyl phosphate or the like. Further, when it is desired that the ink composition is those of the electron beam-curable type or ultraviolet-curable type, useful binders are those generally known in the art as electronbeam curable resin or ultraviolet-curable resin and include compounds that contain at least one, preferably at least two, vinyl or vinylidene group(s) within the molecule, such as a reaction product prepared by reacting a polyol, polyamine or aminoalcohol containing at least one unsaturated group such as acryloyl group, methacryloyl group, allyl group, unsaturated polyester group, vinyloxy group, acrylamido group and the like with an unsaturated carboxylic acid as well as a reaction product prepared by reacting acrylate or methacrylate containing a hydroxy group with a polyisocyanate.

The amount of the binder to be used is about 5 to about 75% by weight, preferably about 10 to about 65% by weight, based on the total solids content in the water-sensitive coloring layer.

When desired, the coating compositions and the printing ink compositions for forming the water-sensitive coloring layer may further contain various additives such as a sensitizer for increasing the sensitivity of color development; an ultraviolet absorber or antioxidant for affording anti-aging properties; and an inorganic pigment or the like for imparting whiteness such as kaolin, clay, talc, calcium carbonate, calcined clay, titanium oxide, diatomaceous earth, silica, activated clay or the like; a coloring pigment or coloring dye.

As stated above, the water-sensitive coloring layer of the present invention can be formed by applying to a substrate a coating composition comprising the foregoing basic dye, color developing material, desensitizer, binder and the like or by printing with use of an ink composition containing these components.

The ink composition for forming a water-sensitive coloring layer of the invention by printing may be prepared by mixing the selected binder with the foregoing basic dye, color developing material, desensitizer and when desired the additive and solvent conventionally used in a conventional manner, and is subjected to printing with use of a various conventional printing apparatus for letterpress printing, litho printing, intaglio printing, flexographic printing, gravure printing, offset printing, screen printing, hot-melt printing or the like.

The coating composition comprising these components is usually prepared by dispersing the dye and color developing material conjointly or separately in water as a dispersing medium employing a stirrer or a mill such as a ball mill, attritor, sand mill or the like, or by emulsifying the basic dye and/or color developing material, or alternatively by dissolving these components in an organic solvent e.g. lower alcohol such as methyl alcohol, ethyl alcohol, di-lower alkyl ketones such as acetone, methyl ethyl ketone or the like.

The methods of applying the coating composition for forming a water-sensitive coloring layer of the water-sensitive coloring sheet according to the invention are not specifically limited and include those well-known and conventionally employed in the art. The coating composition is applied using, for example, a suitable coater such as a bar coater, air knife coater, blade coater, curtain coater or the like.

The amount of the coating composition or printing ink composition to be applied for forming the water-sensitive coloring layer is not critical and is in the range of about 0.3 to about 12 g/m$^2$, preferably about 1 to about 10 g/m$^2$, on dry basis. The amount of less than 0.3 g/m$^2$ fails to give the desired ability to water-sensitive coloring sheets for use with water-writing instruments, whereas the amount of more than 12 g/m$^2$ often fails to achieve further improvement, and hence wasteful.

After application or printing, the coating composition or ink composition may be air-dried but is usually dried at a temperature of about 50° to about 120° C. When the ink composition used for forming a water-sensitive coloring layer is of the electron beam-curable or ultraviolet-curable type, it is of course necessary to cure the applied ink composition by irradiation of electron beam or ultraviolet ray. When required, the thus formed water-sensitive layer after dried may be subjected to a calender treatment.

Substrates, upon which the water-sensitive coloring layer in the invention is formed, can be suitably selected over a wide range without specific limitation and can be any of water repellent substrate, water-absorbing or porous substrates, such as paper sheets or synthetic fiber paper sheets, synthetic resin films, metal panels, metal foils, glass panels, sheets of cotton, nonwoven fabric or textile, wood panels, etc.

Depending on the porosity or water repellency of the selected substrates, the colored images formed by water applied are allowed to disappear or to remain after evaporation of water, as described hereinbefore.

Thus, according to one embodiment of the invention, a water-repellent substrate is used and thereby colored images are reversibly formed and decolorized. In this embodiment, the colored images formed by application of water to the water-sensitive coloring layer disappear on evaporation of water but can be formed again by another application of water.

According to another embodiment of the invention, a porous substrate is used and the colored images formed on the coloring layer by application of water are not decolorized after evaporation of the water but irreversibly left.

If a substrate is insufficient in either porosity or water repellency, obscure colored images of low color density may be left which can not be completely decolorized by evaporation of water. Such obscure colored images left may be useful for some applications. In applications where formation of such obscure colored image should be avoided, the substrate for use in the invention should possess sufficiently low porosity, i.e., sufficient water repellency to completely decolorize the colored images on evaporation of water, or should possess sufficient porosity to retain the colored images of high color density after evaporation of water.

Porosity of the substrates may be conveniently evaluated by a certain property of the substrates such as so-called "flow-length" which can be determined by the following method. That is to say, in an atmosphere adjusted to 20±2° C. and 60±5%RH, a 10 μl of a 1 wt. % aqueous solution of polyoxyethylene sorbitan monolaurate (trade name: Reodol TW-L120, product of KAO Kabushiki Kaisha, Japan) is dropped from an injection needle held 1 cm above onto a substrate which is to be tested for porosity and which is fixed on a flat plane inclined at an angle of 75° from the horizontal to determine the length of flow formed on the inclined substrate until dried.

According to our investigation, if less porous substrate such as those having a flow-length of at least 55 mm, preferably at least 60 mm is used, the colored image formed by application of water is generally decolorized upon evaporation of the applied water. If porous substrate such as those having a flow-length of about 50 mm or less, preferably about 40 mm or less is used, the colored image formed by application of water generally remains even after evaporation of the applied water.

As described above, when the substrate of the water-sensitive coloring sheet of the invention has a low porosity or high water repellency, a colored image is formed on application of water to the water-sensitive coloring layer and is then decolorized on evaporation of water from the water-sensitive coloring layer. The mechanism for this action remains to be completely clarified but is presumably as follows. On contact with water, the readily water-soluble desensitizer in the water-sensitive coloring layer is diluted therewith to a reduced concentration and decreases the ability to inhibit the color forming reaction between the basic dye and the color developing material with the result that the color forming reaction therebetween is allowed to occur, forming visible images. Reversely as the water applied vaporizes and diminishes in quantity, the desensitizer in the coloring layer becomes concentrated and increases the ability to inhibit the color forming reaction so that the visible images are decolorized. In other words, presumably application and evaporation of water applied change the concentration of desensitizer to cause a reversible reaction between the basic dye and the color developing material, permitting the color formation and decolorization to take place.

When a substrate has sufficient porosity, the coloring layer on the water-sensitive coloring sheet of the invention is caused to develop a color on contact with water and the images are not decolorized after evaporation of water, as described hereinbefore. The mechanism for this action, which also remains to be completely clarified, is presumably based on the following phenomena. On contact with water, the desensitizer in the coloring layer is dissolved in water to a reduced concentration and decreases the ability to inhibit the color forming reaction between the basic dye and the color developing material, whereby the color forming reaction therebetween is induced, forming visible images. The resulting desensitizer solution is then penetrated into the porous substrate to reduce the proportion of the desensitizer in the coloring layer so that the color formed is irreversibly left even after evaporation of water.

Described below is a method for forming colored images by application of water to the water-sensitive coloring sheet of the invention. Since there is no specific restriction on the mode of application of water, water can be applied in a manner selected according to particular use. To record, for example, letters, figures or the like on the water-sensitive coloring sheet, writing is conducted by means of writing instruments heretofore employed, such as pens, fountain pens, writing brushes or the like using water in place of ink. The water is applied in an amount effective for forming visible colored images on the water-sensitive coloring layer.

The water-sensitive coloring sheets of the type capable of decolorizing the images on evaporation of water can reversibly repeat color formation and decolorization and thus can be used for practicing at writing letters or the like. On the other hand, the water-sensitive coloring sheets of the type capable of retaining the colored images without decolorization after evaporation of water applied can be used for keeping colored images sought to be stored for a long period of time.

The water-sensitive coloring sheets of the invention additionally have the following advantages.

(1) The color to be developed can be easily changed by selecting a suitable basic dye.

(2) While the water-sensitive coloring layer of the invention is usually colorless, a coloring agent such as a coloring dye or coloring pigment may be used for coloring the water-sensitive coloring layer. By using such coloring agent, there occurs a color change, upon application of water, from the initial color of the coloring agent to a color mixture of such initial color and a color formed by application of water. Consequently the water-sensitive coloring sheets of the invention can find applications, for example, as toys and the like.

(3) The water-sensitive coloring sheets of the type free from decolorizing after evaporation of water can be used for producing prints of hand, foot, fish or the like, conveniently using water alone instead of black ink or cinnabar red ink that tends to soil fingers and the like originals for producing such prints.

(4) With the advantage of forming a color on contact with water, the water-sensitive coloring sheets of the invention are suitable for use in various applications, for example, as in water leakage detectors or in water guns for a survival game to be played therewith.

(5) Colors can be developed also with urine on the water-sensitive coloring sheet of the invention. With a paper diaper produced with use of such water-sensitive coloring sheet as one of the elements, for example as a backing sheet, the presence or absence of excretion excreted inside the diaper can be easily recognized from outside the diaper as it is worn by a user, by the presence or absence of the coloration of the sheet without a touch thereon by a hand. For this reason, paper diapers produced with use of the sheet of the invention are advantageous from the sanitary viewpoint. Further, since the degree of wetting of the diaper used can be grasped from the area of the colored portions thereof, appropriate times for exchanging diapers can be suitably determined.

(6) The water-sensitive coloring layer of the invention is usually colorless. Therefore when such colorless water-sensitive coloring layer is formed in a hidden manner by printing on at least a portion of the surface of securities, labels or other documents, the genuineness thereof can be easily and instantly examined by application of water, whereby the coloring layer of the invention has a wide variety of applications such as prevention of forgery, preparation of secret documents and the like.

The present invention will be described below in further detail with reference to the following Examples to which the scope of the invention is not limited. In the following Examples, "parts" and "percentages" are all by weight unless otherwise specified.

Further, "flow-length" used as an index of porosity of the substrate used was determined by the following method. That is to say, in an atmosphere adjusted to 20±2° C. and 60±5%RH, a 10 μl of a 1 wt. % aqueous solution of polyoxyethylene sorbitan monolaurate (trade name: Reodol TW-L120, product of KAO Kabushiki Kaisha, Japan) was dropped from an injection needle held 1 cm above onto a substrate which was to be tested for porosity and which was fixed on a flat plane inclined at an angle of 75° from the horizontal to determine the length of flow formed on the inclined substrate until dried.

EXAMPLE 1

Preparation of mixture A

| | |
|---|---|
| 3-(N-Ethyl-N-isoamyl)amino-6-methyl-7-phenylaminofluoran | 10 parts |
| 5% Aqueous solution of methyl cellulose | 5 parts |
| Water | 40 parts |

The above mixture was pulverized by a sand mill to a mean particle size of 3 μm.

Preparation of mixture B

| | |
|---|---|
| 4,4'-Isopropylidene diphenol | 20 parts |
| 5% Aqueous solution of methyl cellulose | 5 parts |
| Water | 55 parts |

The above mixture was pulverized by a sand mill to a mean particle size of 3 μm.

A 55 parts quantity of the mixture A, 80 parts of the mixture B, 55 parts of polyethylene glycol #600 (average molecular weight: 600), 15 parts of silicon oxide pigment (oil absorption: 180 ml/100 g), 50 parts of a 20% aqueous solution of oxidized starch and 10 parts of water were mixed together and agitated to prepare a coating composition. The obtained coating composition was applied to a water-repellent double-side coated paper (flow-length: 80 mm) weighing 127.9 g/m$^2$ in an amount of 6 g/m$^2$ on dry basis using a wire bar. The coated paper was dried at 120° C. for 1 minute to produce a white-colored water-sensitive coloring sheet.

On writing on the obtained water-sensitive coloring sheet with a writing brush impregnated with water, vivid black color was developed on the portions of the sheet which were moistened with water. After the sheet was dried for vaporizing water, the black-colored portions of the sheet turned white again, and the sheet was found to be applicable to repetitive use.

EXAMPLE 2

A white-colored water-sensitive coloring sheet was produced in the same manner as in Example 1 with the exception of using polyethylene glycol #1000 (average molecular weight: 1000) in place of polyethylene glycol #600. When the obtained white sheet was moistened with water, vivid black color was also developed on the wet portions of the sheet. After the sheet was dried for vaporizing water, the black-colored portions of the sheet turned white again. Further, the sheet was found to be applicable to repetitive use.

EXAMPLE 3

A white-colored water-sensitive coloring sheet was obtained by the same procedure as in Example 1 with the exception of using 35 parts of polyethylene glycol #300 (average molecular weight: 300) and 20 parts of polyethylene glycol #2000 (average molecular weight: 2000) in lieu of 55 parts of polyethylene glycol #600. When the thus obtained white sheet was moistened with water, black color was developed on the wet portions of the sheet. After the sheet was dried for vaporizing water, the black-colored portions of the sheet turned white again, and further the sheet was found to be usable repeatedly.

EXAMPLE 4

A white-colored water-sensitive coloring sheet was prepared in the same manner as in Example 1 with the exception of using, in preparation of the mixture A, 3-diethylamino-7-chlorofluoran in place of 3-(N-ethyl-N-isoamyl)amino-6-methyl-7-phenylaminofluoran. In the case where the obtained white sheet was moistened with water, vivid orange color was developed on the wet portions of the sheet. After the sheet was dried for vaporizing water, the orange-colored portions of the sheet turned white again, and further the sheet was found to be applicable to repetitive use.

EXAMPLE 5

A white-colored water-sensitive coloring sheet was produced in the same manner as in Example 1 with the exception of using, in preparation of the mixture A, 3,3-bis(p-dimethylaminophenyl)-6-dimethylaminophthalide in place of 3-(N-ethyl-N-isoamyl)amino-6-methyl-7-phenylaminofluoran. When the obtained white sheet was moistened with water, vivid blue color was developed on the wet portions of the sheet. After the sheet was dried for vaporizing water, the blue-colored portions of the sheet turned white again, and the sheet was found to be applicable to repetitive use.

EXAMPLE 6

Preparation of mixture A

| | |
|---|---|
| 3-(N-Ethyl-N-isoamyl)amino-6-methyl-7-phenylaminofluoran | 10 parts |
| 5% Aqueous solution of methyl cellulose | 5 parts |
| Water | 40 parts |

The above mixture was pulverized by a sand mill to a mean particle size of 3 μm.

Preparation of mixture B

| | |
|---|---|
| Zinc 3,5-di-(α-methylbenzyl)salicylate | 20 parts |
| 5% Aqueous solution of methyl cellulose | 5 parts |
| Water | 55 parts |

The above mixture was pulverized by a sand mill to a mean particle size of 3 μm.

Fifty-five parts of the mixture A, 80 parts of the mixture B, 55 parts of Emulgen 935 (trade name for polyoxyethylene nonyl phenyl ether, manufactured by Kao Soap Co., Ltd.), 15 parts of silicon oxide pigment (oil absorption: 180 ml/100 g), 150 parts of 48% styrenebutadiene copolymer latex and 100 parts of water were mixed together and agitated, producing a coating composition. The coating composition obtained was applied to a double-side coated paper (flow-length: 80 mm) weighing 127.9 g/m$^2$ (which was the same one as used in Example 1) in an amount of 6 g/m$^2$ on dry basis with use of a wire bar. The coated paper was dried at 110° C. for 1 minute to produce a white-colored water-sensitive coloring sheet.

On writing on the water-sensitive coloring sheet with a writing brush impregnated with water, vivid black color was developed on the portions of the white sheet which were moistened with water. After dried for evaporation of water thereon, the black-colored portions of the sheet turned white again, whereby the sheet was found to be applicable to repetitive use.

EXAMPLE 7

A white-colored water-sensitive coloring sheet was prepared in the same manner as in Example 6 with the exception of using Emulgen 147 (trade name for polyoxyethylene lauryl ether, manufactured by Kao Soap Co., Ltd.) in place of Emulgen 935. In the case where the thus obtained white sheet was moistened with water, vivid black color was also developed on the wet portions of the sheet. After the sheet was dried for vaporizing water, the black-colored portions of the sheet turned white again, and the sheet was found to be applicable to repetitive use.

EXAMPLE 8

A white-colored water-sensitive coloring sheet was obtained by the same procedure as in Example 6 with the exception of using Reodol TW-L120 (trade name for polyoxyethylenesorbitan monolaurate, manufactured by Kao Soap Co., Ltd.) in lieu of Emulgen 935. When the obtained white sheet was moistened with water, black color was developed also on the wet portions of the sheet. After the sheet was dried for vaporizing water, the black-colored portions of the sheet turned white again, and the sheet was found to be applicable to repetitive use.

EXAMPLE 9

A white-colored water-sensitive coloring sheet was produced in the same manner as in Example 6 with the exception of using Tracks N-300 (trade name for an anionic surfactant, manufactured by Nippon Oil And Fats Co., Ltd.) in place of Emulgen 935. In the case where the thus obtained white sheet was moistened with water, black color was developed on the wet portions of the sheet. After the sheet was dried for vaporizing water, the black-colored portions of the sheet turned white again, and further the sheet was found to be applicable to repetitive use.

EXAMPLE 10

A white-colored water-sensitive coloring sheet was obtained by the same procedure as in Example 6 with the exception of using Epomin P-1000 (trade name for polyethyleneimine, average molecular weight: 70,000, manufactured by Nippon Shokubai Kagaku Kogyo Co., Ltd.) in lieu of Emulgen 935. When the obtained white sheet was moistened with water, black color was developed also on the wet portions of the sheet. After the sheet was dried for vaporizing water, the black-colored portions of the sheet turned white again, and the sheet was found to be applicable to repetitive use.

EXAMPLE 11

A white-colored water-sensitive coloring sheet was prepared in the same manner as in Example 6 with the exception of using, in preparation of the mixture A, 3-diethylamino-7-chlorofluoran in place of 3-(N-ethyl-N-isoamyl)amino-6-methyl-7-phenylaminofluoran. When the obtained white sheet was moistened with water, vivid orange color was developed on the wet portions of the sheet. After the sheet was dried for vaporizing water, the orange-colored portions of the sheet turned white again, and the sheet was found to be applicable to repetitive use.

EXAMPLE 12

A white-colored water-sensitive coloring sheet was produced in the same manner as in Example 6 with the exception of using, in preparation of the mixture A, 3,3-bis(p-dimethylaminophenyl)-6-dimethylaminophthalide in place of 3-(N-ethyl-N-isoamyl)amino-6-methyl-7-phenylaminofluoran. In the case where the thus obtained white sheet was moistened with water, vivid blue color was developed on the wet portions of the sheet. After the sheet was dried for vaporizing water, the blue-colored portions of the sheet turned white again, and the sheet was found to be applicable to repetitive use.

EXAMPLE 13

A coating composition was prepared as follows.

Mixture A

| | |
|---|---|
| 35% Aqueous dispersion of 3,3-bis(p-dimethylaminophenyl)-6-dimethylaminophthalide pulverized by a sand mill | 30 parts |
| 30% Aqueous dispersion of zinc 3,5-di(α-methylbenzyl)salicylate pulverized by a sand mill | 70 parts |
| 48% Styrene-butadiene copolymer latex | 100 parts |

Mixture B

| | |
|---|---|
| Polyethylene glycol #1000 (average molecular weight: 1000) | 100 parts |
| Water | 100 parts |

The mixture B was gradually added to the mixture A with stirring such that the ratio of mixture A:mixture B became 100:50 to prepare a coating composition. The obtained composition was applied to a base paper weighing 64 g/m$^2$ (size fastness: 30 seconds, flow-length: 10 mm) with use of a blade coater. The coated paper was dried at 100° C. for 1 minute to produce a white-colored water-sensitive coloring sheet. The amount of the coating composition applied was 3.5 g/m$^2$ on dry basis.

On writing on the obtained white sheet with a writing brush impregnated with water, vivid blue color was developed on the portions of the sheet which were moistened with water. The blue thus developed on these portions remained unchanged even when the sheet was left to stand and dried.

EXAMPLE 14

A white-colored water-sensitive coloring sheet was prepared by the same procedure as in Example 13 with the exception of using a base paper weighing 64 g/m$^2$ (size fastness: 70 seconds, flow-length: 20 mm) in place of the base paper weighing 64 g/m$^2$ (size fastness: 30 seconds, flow-length: 10 mm). When water was sprinkled over the obtained white sheet with a spray, color development was caused irreversibly on the portions of the sheet to which the water droplets adhered, and the color thus developed on these portions remained unchanged even when the sheet was dried.

EXAMPLE 15

A white-colored water-sensitive coloring sheet was produced in the same manner as in Example 13 except that the mixing ratio of the mixture A to the mixture B was changed to mixture A:mixture B=100:75 and that a base paper weighing 64 g/m$^2$ (size fastness: up to 1 second, flow-length: 10 mm) was used. When the hand wet with water was pressed on the obtained white sheet, a blue-colored hand print was formed on the sheet and the blue color thus developed irreversibly remained unchanged even when the sheet was dried.

EXAMPLE 16

A white-colored water-sensitive coloring sheet was produced in the same manner as in Example 13 with the exception of using, in preparation of the mixture A, 3-diethylamino-7-chlorofluoran in place of 3,3-bis(p-dimethylaminophenyl)-6-dimethylaminophthalide. In the case where the thus obtained white sheet was moistened. with water, vivid orange color was developed on the wet portions of the sheet and the orange color thus irreversibly developed remained unchanged even when the sheet was dried.

EXAMPLE 17

A white-colored water-sensitive coloring sheet was prepared in the same manner as in Example 13 with the exception of using, in place of a base paper weighing 64 g/m$^2$ (size fastness: 30 seconds, and flow-length: 10 mm), a coated paper (flow-length: 160 mm) which was prepared by applying, using a wire bar, to said base paper a coating composition consisting of 100 parts of 48% styrene-butadiene copolymer emulsion, 20 parts of calcium carbonate and 100 parts of water in an amount of 5 g/m$^2$ on dry basis and drying the coated base paper. When the obtained white sheet was moistened with water, blue color was developed on the wet portions of the sheet. After the sheet was dried for evaporation of water, the blue-colored portions of the sheet turned white again, and the sheet was found to be applicable to repetitive use.

EXAMPLE 18

Preparation of mixture A

Five parts of 3-(N-ethyl-N-isoamyl)amino-6-methyl-7-phenylaminofluoran was dissolved in 100 parts of alkylnaphthalene. The obtained solution was added to 100 parts of a 3% aqueous solution of polyvinyl alcohol and the mixture was agitated with a homomixer at 8500 rpm for 3 minutes, giving an emulsion (mixture A).

Preparation of mixture B

A composition prepared from 10 parts of zinc 3,5-di(α-methylbenzyl)salicylate, 5 parts of a 5% aqueous solution of methyl cellulose and 55 parts of water was '-pulverized by a sand mill to a mean particle size of 3 μm, giving a mixture B Subsequently, a coating composition was prepared by mixing together with stirring 205 parts of the mixture A, 70 parts of the mixture B, 25 parts of polyethylene glycol #1000 (average molecular weight: 1000), 100 parts of silicon oxide pigment (oil absorption: 180 ml/100 g), 150 parts of 48% styrene-butadiene copolymer emulsion and 300 parts of water.

On the other hand, a woodfree paper weighing 104.7 g/m$^2$ was coated with a coating composition consisting of 100 parts of 48% styrene-butadiene copolymer emulsion, 20 parts of calcium carbonate and 100 parts of water using a wire bar and the coated paper was dried to form a coating layer having a dry weight of 5 g/m$^2$ (flowlength: 160 mm). The coating composition obtained above was applied to the surface of the coating layer with a wire bar and the coated surface was dried at room temperature, giving a white-colored water-sensitive coloring sheet. The amount of the coating composition applied was 7 g/m$^2$ on dry basis.

On writing on the thus obtained water-sensitive coloring sheet with a writing brush impregnated with water, vivid black color was developed on the portions of the sheet which were moistened with water. After the sheet was left to stand for evaporation of water, the black-colored portions of the sheet turned white again and thus the sheet was found to be applicable to repetitive use.

EXAMPLE 19

Preparation of C

In 100 parts of alkylnaphthalene were dissolved 5 parts of 3-(N-ethyl-N-isoamyl)amino-6-methyl-7-phenylaminofluoran and 10 parts of zinc 3,5-di-(α-methylbenzyl)salicylate. The obtained solution was added to 100 parts of a 3% aqueous solution of polyvinyl alcohol and the resulting mixture was stirred by a homomixer at 8500 rpm for 3 minutes to prepare an emulsion (mixture C).

A white-colored water-sensitive coloring sheet was produced by the same procedure as in Example 18 with the exception of using 215 parts of the mixture C in lieu of 205 parts of the mixture A and 70 parts of the mixture B.

On writing on the sheet thus obtained with a writing brush impregnated with water, vivid black color was developed on the portions of the sheet which were moistened with water. After the sheet was left to stand for evaporation of water, the black-colored portions of the sheet turned white again. In this way, the obtained white sheet was found to be applicable to repetitive use.

EXAMPLE 20

(1) Production of water-sensitive coloring material

| | |
|---|---|
| 35% Aqueous dispersion of 3,3-bis(p-dimethylaminophenyl)-6-dimethylaminophthalide pulverized by a sand mill | 30 parts |
| 38% Aqueous dispersion of zinc 3,5-di(α-methylbenzyl)salicylate pulverized by a sand mill | 55 parts |
| 50% Aqueous solution of polyethylene glycol #1000 (average molecular weight: 1000) | 60 parts |
| 48% Styrene-butadiene copolymer latex | 100 parts |
| 30% Aqueous dispersion of calcium carbonate (oil absorption: 95 ml/100 g) | 70 parts |

The above ingredients were mixed together with stirring to produce a coating composition as a water-sensitive coloring material.

(2) Production of paper diaper

The coating composition obtained in (1) above was applied with a wire bar to the surface of a film made of polypropylene (trade name: Pylen Film OT, thickness: 20 μm, and manufactured by Toyobo Co., Ltd.) which surface had been subjected to corona treatment. The coated film was dried at 80° C. for 30 seconds to prepare a film having a white-colored water-sensitive coloring layer, which was to be used as backing sheet of paper diaper herein. The amount of the coating composition applied was 3.5 g/m$^2$ on dry basis.

On the coated side of the obtained film were superposed a water-absorptive fleecy pulp material containing a polyacrylic acid-based polymer high in water absorbing capacity, and a surface sheet consisting of a non-woven fabric in this order to produce paper diaper.

In the case where urine was sprinkled over the surface sheet of the diaper, blue color was developed on the portions of the polypropylene film which were wetted with urine. When the diaper was inspected from the rear side thereof, the portions of the film that was wetted with urine were clearly distinguished from the portions free of urine.

Urine was further sprinkled over the surface sheet of the diaper in varying amounts of 10, 20 and 30 cc. When the diapers thus wetted with urine were allowed to stand for 5 minutes under a load of 10 g/cm$^2$, the area of the portions of the diaper on which colors were developed was 5, 20 and 50 cm$^2$, respectively.

EXAMPLE 21

To a mixture of 80 parts of oligoester acrylate (trade name: Aronix M-8030, product of Toagosei Chemical Inudstry Co., Ltd.) and 80 parts of monofunctional acrylate (trade name: Aronix M-101, product of Toagosei Chemical Industry Co., Ltd.) were added 10 parts of 3,3-bis(p-dimethylaminophenyl-6-dimethylaminophthalide, 25 parts of polyethylene glycol #1000 (average molecular weight: 1000). The mixture obtained was melted by heating at 60° C. for 1 hour, giving an electron beam-curable coating composition.

A floral design was printed on an art paper (flow-length: 80 mm) using the coating composition obtained above with use of a letterpress printing apparatus. Then the printed paper was irradiated with electron beam at a dose of 2 Mrad with use of an electron beam-irradiating apparatus of electro-curtain type (model: CB-150, manufactured by Energy Sciences Inc.) to cure the coating composition, giving a white-colored water-sensitive coloring sheet. When the sheet thus obtained was copied with use of a xerographic copying machine, there was merely obtained a blank copy on which the floral design was not reproduced.

On moistening the white-colored water-sensitive coloring sheet obtained above with water using a writing brush or the like, blue color was developed in the form of the floral design. After the sheet was left to stand for evaporation of water, the blue color of the floral design disappeared, thereby showing reversible nature of the coloration by application of water and decoloration by evaporation of water.

EXAMPLE 22

Preparation of coating composition A

| | |
|---|---|
| Polyvinyl butyral (trade name: BLS, product of Sekisui Chemical Co., Ltd.) | 100 parts |
| 3,3-bis(p-Dimethylaminophenyl)-6-dimethylaminophthalide | 10 parts |
| Zinc 3,5-di(α-methylbenzyl)salicylate | 20 parts |
| Polyethylene glycol #1000 (average molecular weight: 1000) | 40 parts |
| Ethyl alcohol | 400 parts |
| Methyl ethyl ketone | 200 parts |

The above ingredients were mixed together with stirring, giving a coating composition (hereinafter referred to as "coating composition A"). The composition was applied to a synthetic paper (trade name: Yupo, weighing 110 g/m$^2$, product of Oji-Yika Goseishi Kabushiki Kaisha) in an amount of 3.0 g/m$^2$ on dry basis with use of a wire bar. The coated paper was dried at 80° C. for 30 seconds to prepare a white-colored water-sensitive coloring sheet. Black-colored letters were printed on the coated side of the sheet with use of a flexographic printing apparatus. On moistening the white portions of the printed sheet with water using a writing brush, blue color was developed on the wet portions of the sheet. Thus, it was revealed that colors could be reversibly developed and erased on the sheet. Further, in the case where the printed sheet was copied with use of a xerographic copying machine, the black-colored letters could be copied. Of course the obtained copy did not exhibit any change even when moistened with water.

EXAMPLE 23

A red-colored water-sensitive coloring sheet was prepared in the same manner as in Example 22 with the exception of adding to the coating composition A 0.8 part of a colored dye Rhodamine 6G (trade name for a product of Kishida Chemical Co., Ltd.). Black-colored letters were printed on the coated side of the obtained red sheet with use of a flexographic printing apparatus. On moistening the unprinted portions of the printed sheet with water using a writing brush, a color mixture (purple) was developed thereon. Further, it was revealed that coloration by application of water and decoloration upon evaporation of water were reversible. When the printed sheet was copied using a commercially available copying machine capable of reproducing the colors of original, there was obtained a copy having the same hue as of the original printed sheet. However, the obtained copy exhibited no change even when moistened with water.

I claim:

1. A water-sensitive coloring sheet comprising:
(a) a substrate and
(b) a water-sensitive coloring layer containing an unencapsulated colorless or pale-colored basic dye, an unencapsulated color developing material capable of entering into a color forming reaction with the dye, a desensitizer and a binder, substantially all of the dye and substantially all of the color developing material present in said water-sensitive coloring layer being capable of entering into said color forming reaction in the absence of said desensitizer, said desensitizer being present in an amount sufficient to prevent the color formation reaction between substantially all of said dye and substantially all of said developing material present in said coloring layer when water is absent from the coloring layer and insufficient to prevent said color forming reaction when water is present in the coloring layer.

2. A water-sensitive coloring sheet according to claim 1 wherein the desensitizer is at least one compound selected from the group consisting of polyolefin glycols, anionic surfactants, nonionic surfactants and polyethyleneimine.

3. A water-sensitive coloring sheet according to claim 1 wherein the desensitizer is a polyolefin glycol having an average molecular weight of about 300 to about 2,000.

4. A water-sensitive coloring sheet according to claim 1 wherein the desensitizer is a polyethyleneimine having an average molecular weight of about 30,000 to about 100,000.

5. A water-sensitive coloring sheet according to claim 1 wherein the desensitizer is an anionic surfactant selected from the group consisting of sodium polyoxyethylenealkyl ether sulfate, triethanolamine polyoxyethylenealkyl ether sulfate and sodium polyoxyethylenealkyl phenyl ether sulfate.

6. A water-sensitive coloring sheet according to claim 1 wherein the desensitizer is a nonionic surfactant selected from the group consisting of polyoxyethylene lauryl ether, polyoxyethylene oleyl ether, polyoxyethylene nonyl phenol ether, polyoxyethylene sorbitan monolaurate and polyethylene glycol monostearate.

7. A water-sensitive coloring sheet according to claim 1 wherein the desensitizer is used in an amount of about 30 to about 2,000 parts by weight per 100 parts by weight of the color developing material.

8. A water-sensitive coloring sheet according to claim 1 wherein the desensitizer is used in an amount of about 50 to about 2,000 parts by weight per 100 parts by weight of the color developing material.

9. A water-sensitive coloring sheet according to claim 1 wherein the substrate is water-repellent.

10. A water-sensitive coloring sheet according to claim 1 wherein the substrate is porous.

11. A water-sensitive coloring sheet according to claim 1 wherein the color developing material is used in an amount of about 50 to about 600 parts by weight per 100 parts by weight of the colorless or pale-colored basic dye.

12. A method for forming a colored image on a water-sensitive coloring sheet, said sheet comprising a substrate and a water-sensitive coloring layer containing a colorless or pale-colored basic dye, a color developing material capable of forming a color on contact with said dye, a desensitizer and a binder, said desensitizer being present in an amount sufficient to prevent said formation of said color in the absence of water and being insufficient to prevent said formation of said color in the presence of water, the method comprising applying water to the water-sensitive coloring layer to form said color in said water-sensitive coloring layer.

13. A method according to claim 12 wherein the desensitizer comprises at least one compound selected from the group consisting of polyolefin glycols, anionic surfactants, nonionic surfactants and polyethyleneimine.

14. A method according to claim 12 wherein the desensitizer comprises a polyolefin glycol having an average molecular weight of about 300 to 2,000.

15. A method according to claim 12 wherein the desensitizer comprises a nonionic surfactant selected from the group consisting of polyoxyethylene lauryl ether, polyoxyethylene oleyl either, polyoxyethylene nonyl phenol ether, polyoxyetylene sorbitan monolaurate and polyethylene glycol monostearate.

* * * * *